US008522505B2

(12) United States Patent
Beach et al.

(10) Patent No.: US 8,522,505 B2
(45) Date of Patent: Sep. 3, 2013

(54) CONNECTOR FOR BOARDWALK SYSTEM

(75) Inventors: Timothy Jon Beach, Beavercreek, OH (US); Jason Vincent Philbin, Charlotte, NC (US); Robert Louis Zimmerman, Beavercreek, OH (US)

(73) Assignee: Permatrak North America LLC, Beavercreek, OH (US)

( * ) Notice: Subject to any disclaimer, the term of this patent is extended or adjusted under 35 U.S.C. 154(b) by 0 days.

(21) Appl. No.: 13/149,375

(22) Filed: May 31, 2011

(65) Prior Publication Data

US 2012/0304571 A1 Dec. 6, 2012

(51) Int. Cl.

| | |
|---|---|
| ***E04B 1/00*** | (2006.01) |
| ***E04G 21/00*** | (2006.01) |
| ***E04G 23/00*** | (2006.01) |

(52) U.S. Cl.

USPC ..... 52/741.15; 52/582.1; 52/586.1; 52/650.3; 52/190; 52/655.1; 52/263; 403/92; 403/294; 403/297; 403/286

(58) Field of Classification Search

USPC ..... 52/582.2, 586.2, 591.3, 591.5, 474, 52/592.2, 650.3, 189, 190, 191, 586.1, 483.1, 52/480, 650.1, 489.1, 582.1, 655.1, 741.15, 52/263; 403/231, 408.1, 292, 294, 286, 92, 403/297, 189

See application file for complete search history.

(56) References Cited

U.S. PATENT DOCUMENTS

| | | | | |
|---|---|---|---|---|
| 2,620,705 | A * | 12/1952 | Papa et al. | 411/460 |
| 2,885,883 | A * | 5/1959 | Torricelli | 52/189 |
| 4,635,424 | A * | 1/1987 | Drapeau | 52/480 |
| 5,243,804 | A * | 9/1993 | Therrien et al. | 52/664 |
| 5,342,138 | A * | 8/1994 | Saito et al. | 403/189 |
| 5,359,954 | A * | 11/1994 | Kordelin | 114/85 |
| 5,419,649 | A * | 5/1995 | Gilb | 403/231 |
| 5,529,428 | A * | 6/1996 | Bischof | 403/408.1 |
| 5,623,803 | A * | 4/1997 | Willis | 52/650.3 |
| 5,660,016 | A * | 8/1997 | Erwin et al. | 52/483.1 |
| 5,906,084 | A | 5/1999 | Millington et al. | |
| 6,202,377 | B1 * | 3/2001 | Krieger | 52/489.1 |
| 6,314,699 | B1 * | 11/2001 | West | 52/489.1 |
| 6,363,677 | B1 * | 4/2002 | Chen et al. | 52/586.1 |
| 6,402,415 | B1 * | 6/2002 | Eberle, III | 403/231 |
| 6,460,306 | B1 * | 10/2002 | Nelson | 52/582.1 |
| 6,470,641 | B1 * | 10/2002 | Faure | 52/480 |
| 6,711,864 | B2 * | 3/2004 | Erwin | 52/582.1 |
| 6,810,633 | B2 * | 11/2004 | Harris, Sr. | 52/489.2 |
| 6,851,884 | B2 * | 2/2005 | Eberle | 403/231 |
| 7,052,200 | B2 * | 5/2006 | Harris | 403/231 |
| 7,578,105 | B2 * | 8/2009 | Eberle, III | 52/403.1 |
| 7,600,353 | B2 * | 10/2009 | Hafner | 52/582.1 |
| 7,874,113 | B2 * | 1/2011 | Eberle, III | 52/403.1 |
| 8,161,702 | B2 * | 4/2012 | Eberle, III | 52/403.1 |
| 2008/0053019 | A1 | 3/2008 | Rischmueller et al. | |
| 2009/0301024 | A1 | 12/2009 | Rischmueller et al. | |
| 2010/0186338 | A1 | 7/2010 | Rischmueller et al. | |

OTHER PUBLICATIONS

Installation Guidelines, Precast concrete boardwalk system, PermaTrak North America (May 2010).

* cited by examiner

*Primary Examiner* — Chi Q Nguyen
(74) *Attorney, Agent, or Firm* — Thompson Hine L.L.P.

(57) ABSTRACT

A boardwalk system including a first component having a pre-formed recess and a second component having a pre-formed recess. The system further includes a connector configured to be positioned in the recesses of the first and second components to connect the first and second components such that the connector limits the movement of first component away from the second component.

29 Claims, 11 Drawing Sheets

CONNECTOR FOR BOARDWALK SYSTEM

The present invention is directed to a connector, and more particularly, to a connector for use with a boardwalk system.

BACKGROUND

Modular decking systems often include a beam or set of beams which carry a set of treads thereon. The treads extend generally horizontally and provide a generally flat surface upon which a user can walk, ride small vehicles, etc. Treads and other components in existing modular decking systems are often vertically held in place, and prevented from uplifting merely by their weight.

SUMMARY

In one embodiment, the present invention takes the form of a connector which couples the treads or other components to the underlying components to help ensure that the treads remain in place in the presence of high winds, rising waters, or other forces. More particularly, in one embodiment the invention is a boardwalk system including a first component having a pre-formed recess and a second component having a pre-formed recess. The system further includes a connector configured to be positioned in the recesses of the first and second components to connect the first and second components such that the connector limits the movement of first component away from the second component.

DETAILED DESCRIPTION

Figure 1:
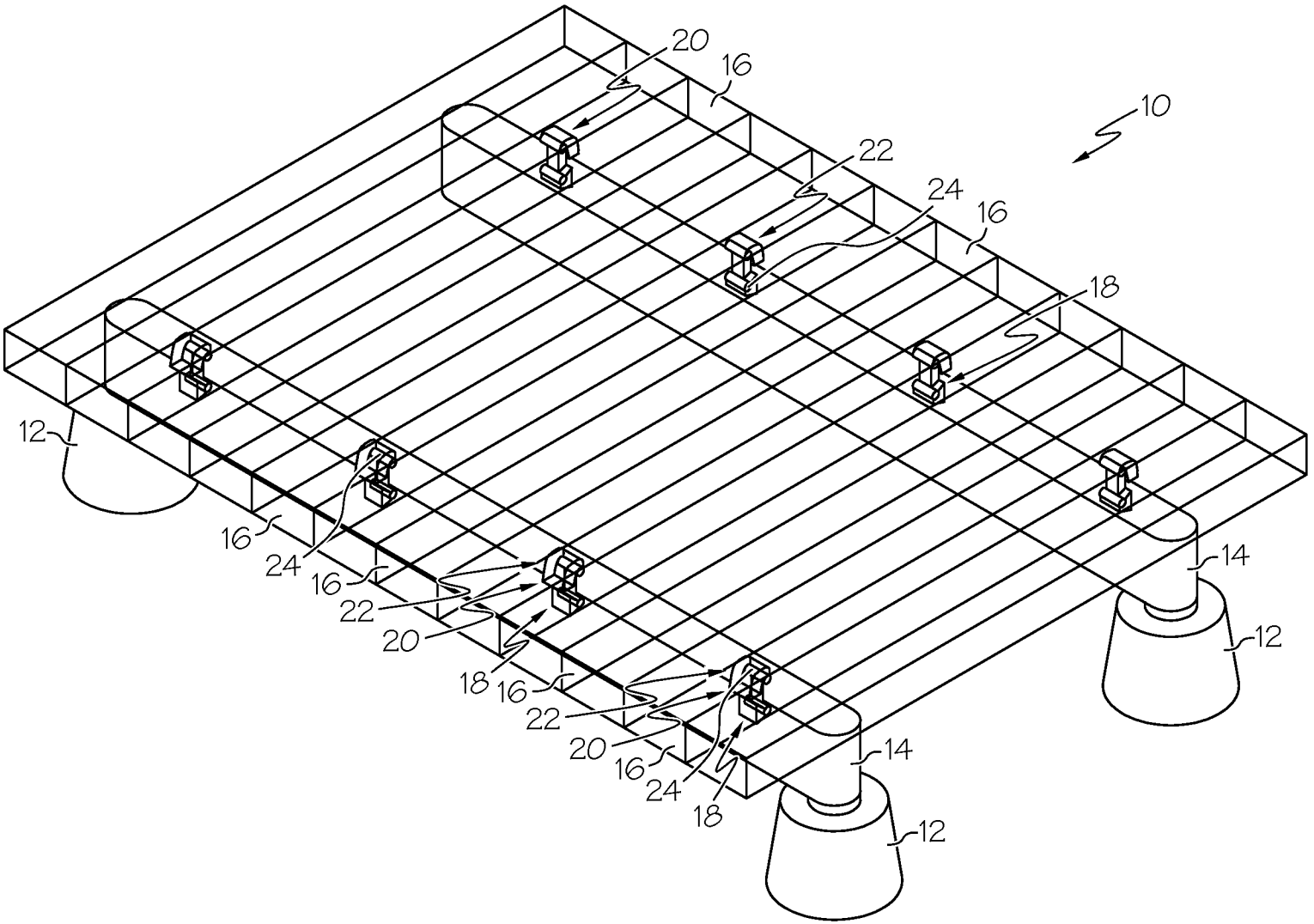
FIG. 1 is a front perspective view of a portion of a boardwalk system.

As shown in FIG. 1, in one embodiment the boardwalk system 10 includes a plurality of piles or supports 12, each of which supports one or more horizontally-extending beams 14 thereon. Each support 12 may rest upon a ground surface and elevate the beams 14 to the desired position. In the illustrated embodiment, each support 12 is shown as being generally cylindrical or conical, although supports 12 can take any of a wide variety of shapes and configurations, as desired, such as a relatively flat supports 12 shown in FIG. 10.

In the illustrated embodiment, each beam 14 extends between a pair of spaced supports 12, although each beam 14 can extend across multiple supports 12, and/or each support 12 may support multiple beams 14 thereon, etc. If desired, the beams 14 can be coupled to the associated support(s) 12 by any of a wide variety of coupling devices or systems.

Each beam 14 supports a plurality of generally horizontally extending treads or planks 16 therein. In the illustrated embodiment, each tread 16 is positioned generally perpendicular to the underlying beams 14, and is supported by two parallel, spaced-apart beams 14 thereunder. However, this arrangement can be varied such that each tread 16 is supported by more than one beam 14, or by only a single beam 14, in which case the tread 16 may be supported at its other end by the earth or other structures.

In the illustrated embodiment each tread 16 is shaped as a generally rectangular prism having a flat upper surface. Moreover, in the illustrated embodiment, each upper surface is generally flat and planar, and positioned relatively close to the upper surface of an associated tread 16 such that upper surfaces together define a generally smooth surface (with gaps between the treads 16, in some cases) which can be walked upon, ridden upon (by small vehicles), etc. If desired, each tread 16 may be coupled to an adjacent tread 16 by, for example, a laterally-extending tongue 15 (FIG. 10) received in an associated groove 17 in the adjacent tread 16.

The supports 12, beams 14 and treads 16 can be made from any of a wide variety of materials, including, but not limited to, wood, wood composite materials or other composite materials, concrete, or materials made entirely or primarily of concrete. Modular decking systems having some features similar to that shown in FIGS. 1 and 10 and described herein are disclosed in U.S. Pat. No. 5,906,084 to Millington et al. and U.S. Patent Application Publication Nos. US2009/0301024 and US2010/0186338 to Rischmueller et al. The entire contents of the above-identified patent and patent applications are incorporated by reference herein.

As shown in FIG. 1, selected ones of the treads 16 include one or more pre-formed recess 18 located on the underside thereof, and at opposite ends thereof. In the embodiment shown in FIG. 1, only certain of the treads 16 include the pre-formed recess(es) 18 formed therein, and other of the treads 16 may lack any of the pre-formed recesses 18. Alternately, if desired, each tread 16 may have the pre-formed recesses 18 formed therein. The recesses 18 may be pre-formed or cast, i.e. during the formation of the treads 16, such that the recesses 18 are present without driving any fasteners into the threads 16.

Each illustrated beam 14 includes a plurality of pre-formed recesses 20 formed therein, formed in the outer surface thereof. Each beam 14, in the particular illustrated embodiment of FIG. 1, includes four recesses 20 along its length, although the number and position of recesses 20 can vary as desired. Each beam recess 20 may be aligned with an associated tread recess 18 to together cooperate to form an opening 22 which can receive a connector 24 therein. In particular, FIG. 1 illustrates a connector 24 positioned in each of the openings 22/aligned recesses 18/20.

Figure 2:
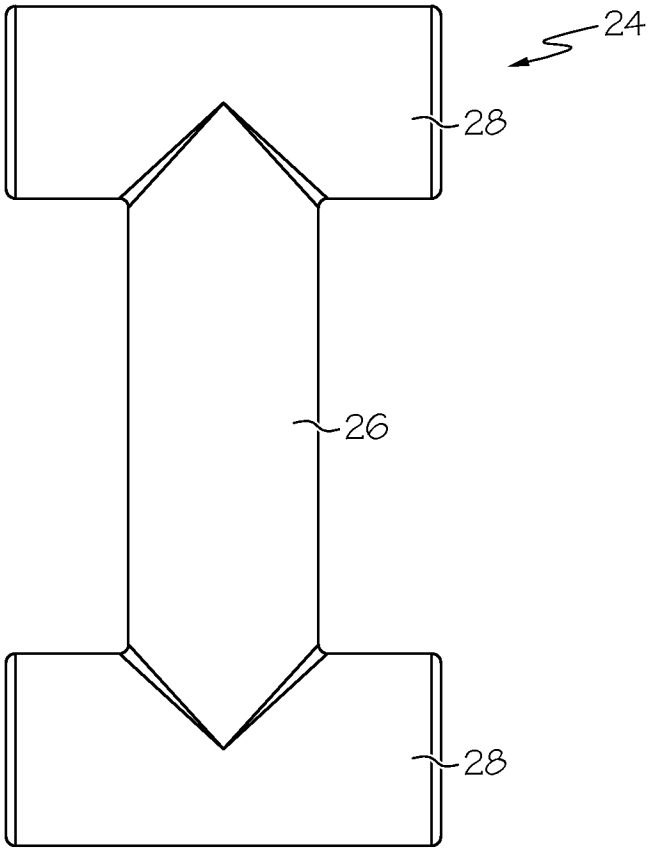
FIG. 2 is a front view of one embodiment of a connector.

As best shown in FIG. 2, each connector 24 may be generally "I" or "H"-shaped or dog-boned shaped, having a central stem 26 and a pair of opposed protrusions 28 located at or adjacent to the end of the central stem 26. In the illustrated embodiment, the central stem 26 is generally tubular and elongated, and terminates at the center of each protrusion 28. Each protrusion 28 is also, in the illustrated embodiment, formed as a tubular body and oriented generally perpendicular to the central stem 26, and having a length shorter than that of the central stem 26. The central stem 26 and protrusions 28 may each be generally cylindrical and have a generally circular cross section, although the cross-sectional shape of the central stem 26 and protrusions 28 and the particular shape of the connector 24 can take any of a wide variety of configurations.

In one embodiment, each connector 24 may be made of a generally elastic material such that each connector 24 can be deformed and return to its original shape after the deforming forces are removed. In particular, in one case each connector 24 may be able to be stretched in the direction of the axis of the central stem 26 at least about 10% of its original length without breaking, or at least about 25% of its original length in another case without breaking, but may not be able to be stretched over about 150% in one case without breaking. Each connector 24 can be made of urethane or a urethane-based material, rubber, synthetic rubber, or other materials. In some cases, then, the connectors 24 can thus be entirely made of a non-ferrous material which resists corrosion, particularly in salt environments.

Figure 3:
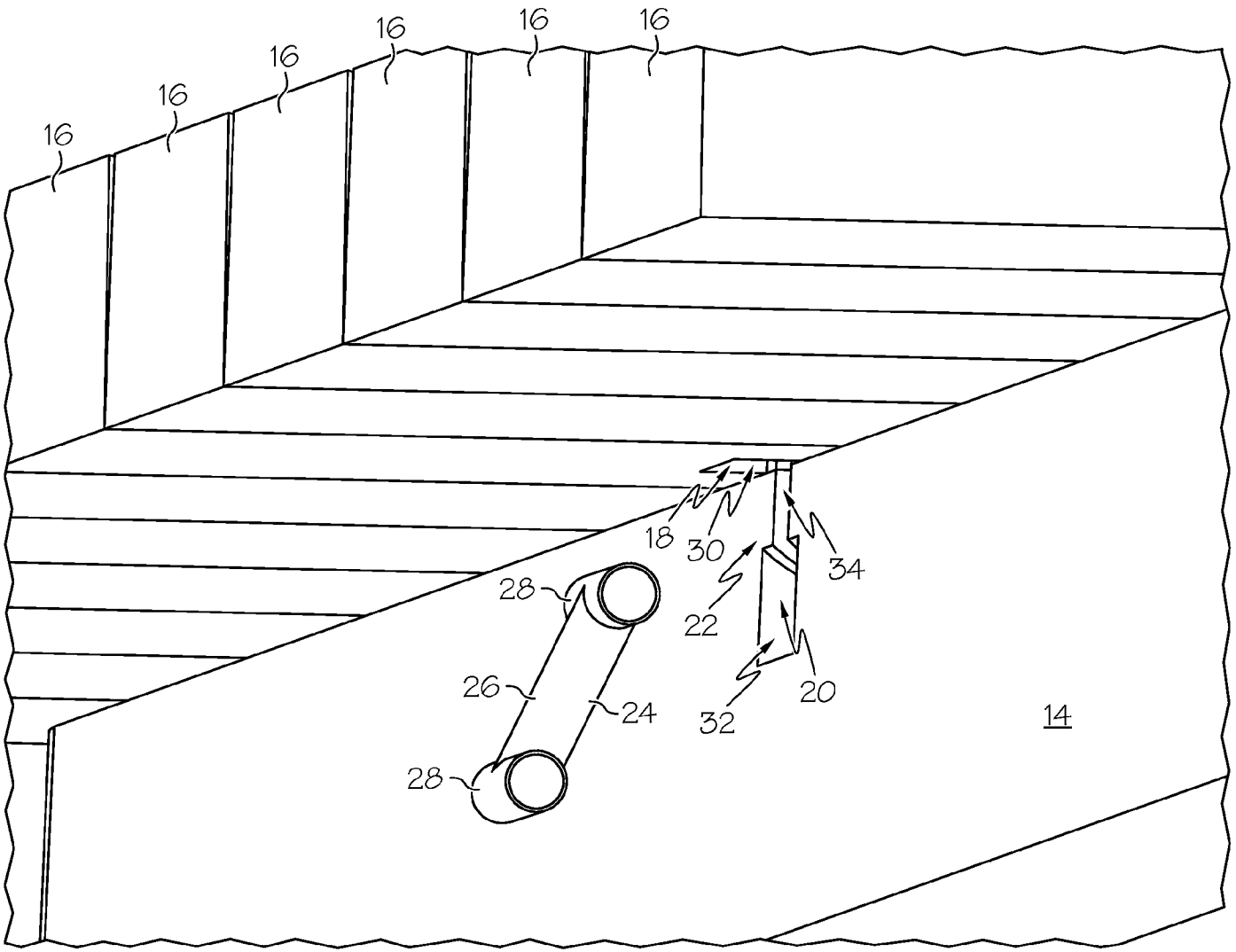
FIG. 3 is a bottom perspective detail view of part of the system of FIG. 1, with the connector shown in an exploded position.

The opening 22 defined by the aligned recesses 18, 20 defines an entry path through which the connector 24 is passed to connect the associated tread 16 to the associated underlying beam 14 (FIG. 3). In particular, the opening 22 includes a relatively wide, generally horizontally-extending first portion or mouth 30 and a relatively wide, generally vertically-extending second portion or mouth 32, wherein the first 30 and second portions 32 are each sized to closely receive a protrusion 28 therein. The first 30 and second 32 portions of the opening 22 are connected by a vertically-extending, relatively narrow third portion 34 which is sized to closely receive the central stem 26 of the connector 24, and is sufficiently narrow to prevent the protrusions 28 from being passed therethrough.

Figure 4:
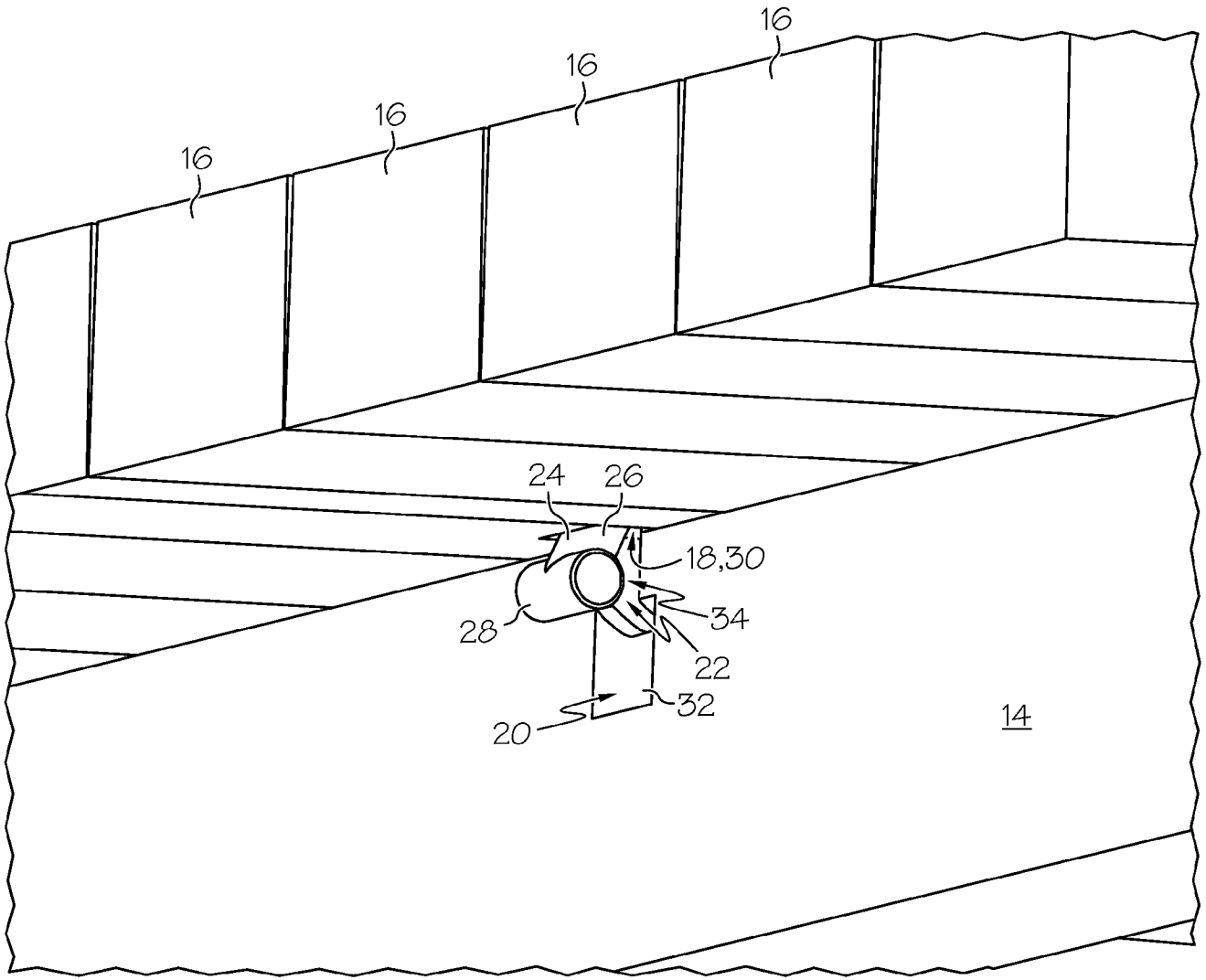
FIGS. 4 and 5 illustrate a series of steps for coupling the connector of FIG. 3 to the associated tread and beam.
Figure 5:
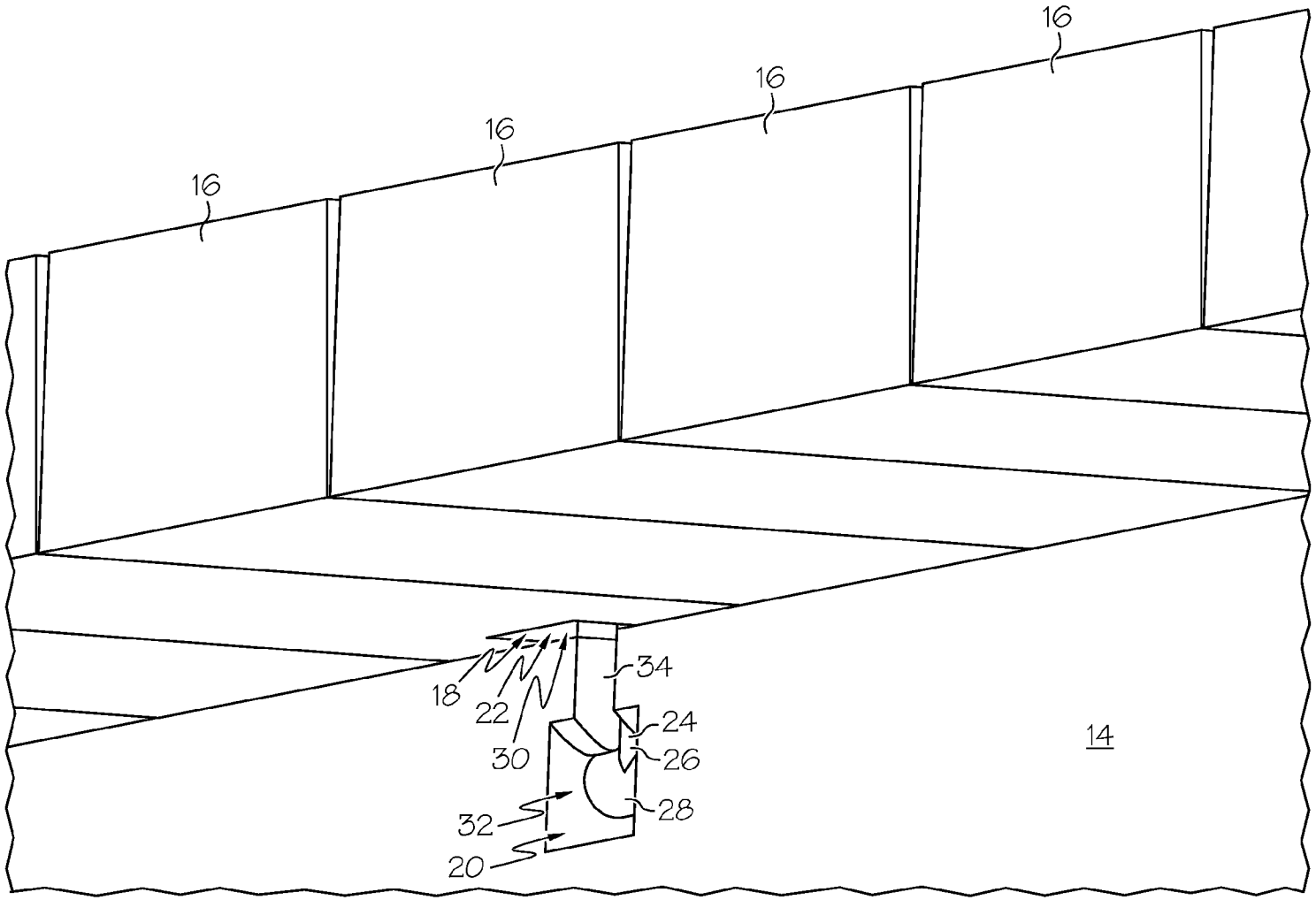
Figure 7:
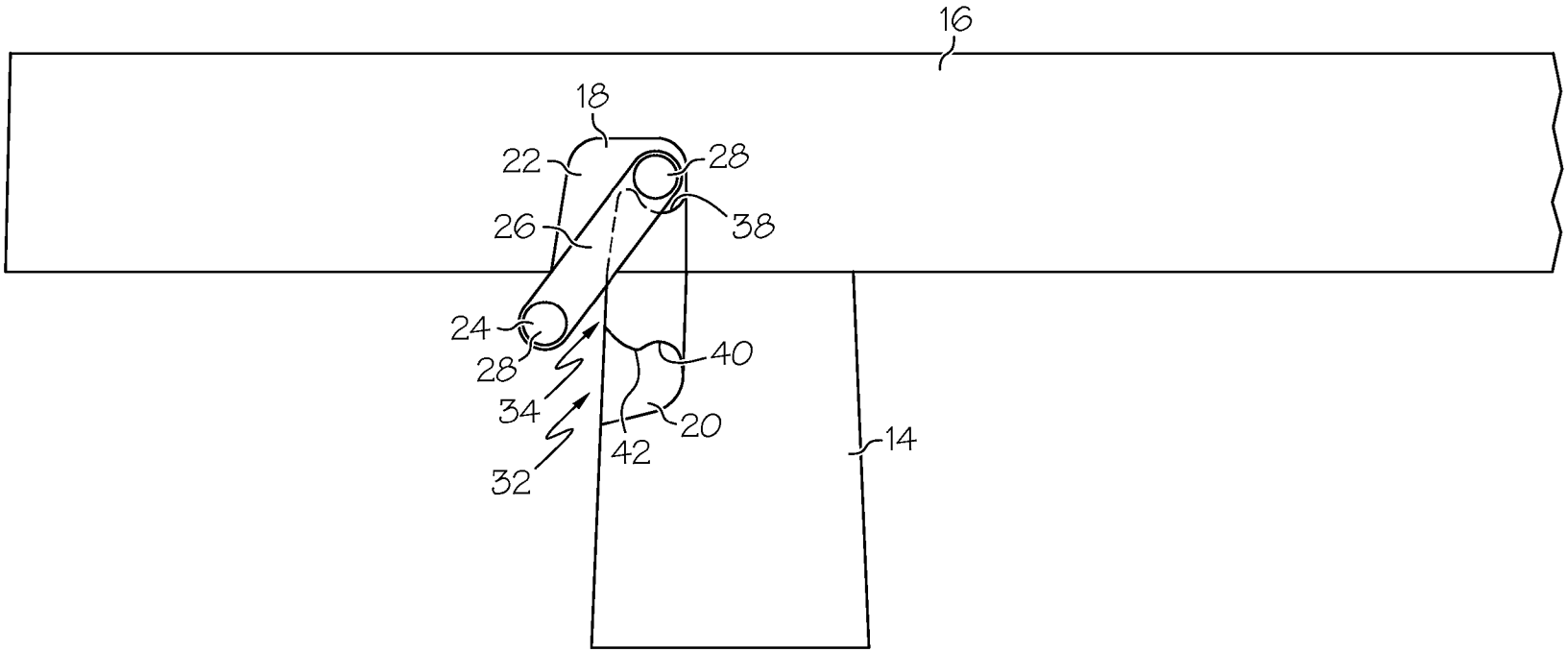
FIGS. 7-9 illustrate a series of steps for coupling the connector of FIG. 6 to the associated tread and beam.
Figure 8:
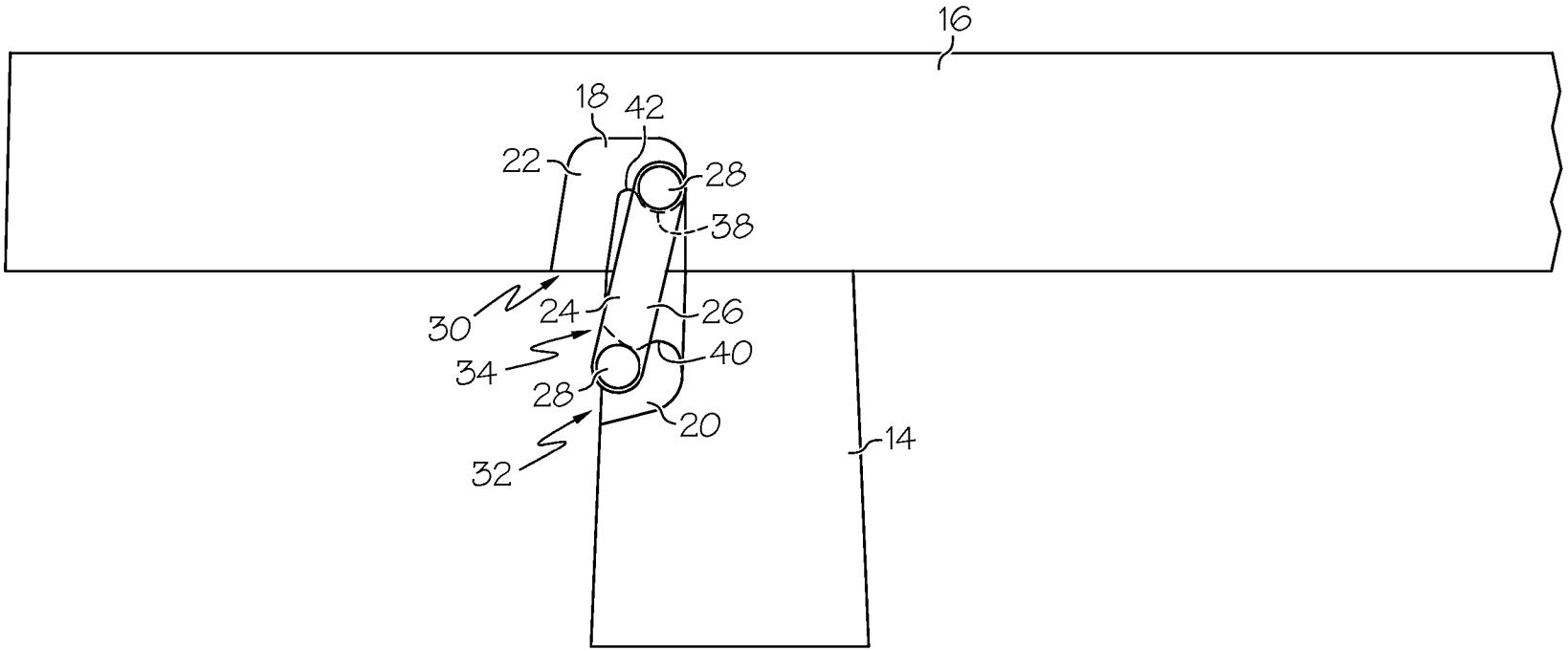
Figure 9:
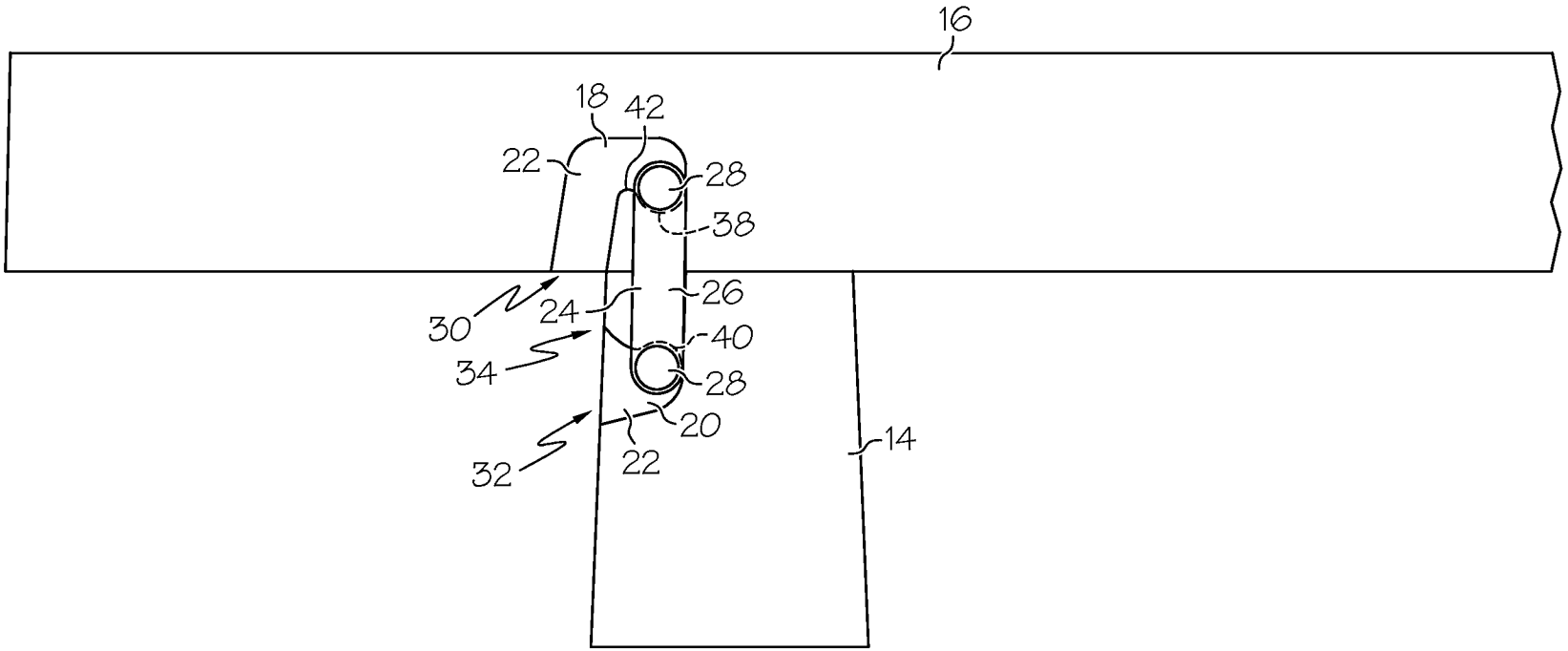

In order to insert the connector 24 into the opening 22/aligned recesses 18, 20, the upper protrusion 28 of the connector 26 is passed through the first portion 30 of the opening 22, as shown in FIGS. 4 and 7. The connector 26 is then further inserted until the upper protrusion 28 is fully seated in an upper notch 38 (FIG. 7) of the opening 22/recess 18. Next, as shown in FIG. 8, the connector 24 is pivoted such that the bottom protrusion 28 passes through the second portion 32 of the opening 22. Next, as shown in FIGS. 5 and 9, the connector 24 is further inserted/pivoted until the connector 24 is seated in the bottom notch 40 of the opening 22/recess 20.

Figure 6:
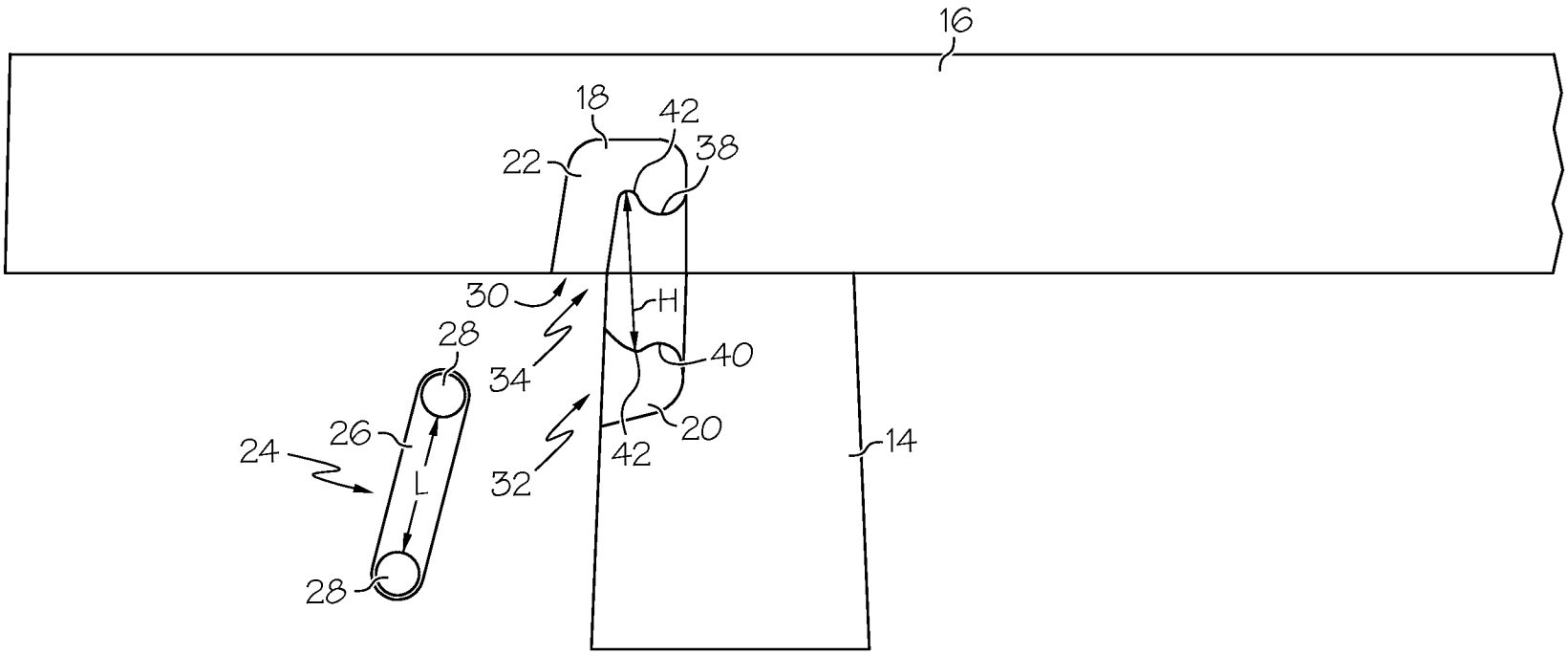
FIG. 6 is a side cross section of the tread and beam of FIG. 1, with the connector shown in an exploded position.

In one case, in order for the connector 24 to be fully seated in the opening 22 (i.e. move from the position shown in FIG. 8 to the position shown in FIG. 9), the connector 24 needs to be stretched along its length. In particular, the opening 22 may have an area of maximum height H (see FIG. 6) which is greater than a length dimension L of the connector 24 defined between the inner-most points of the protrusions 28. Accordingly, in order for the connector 24 to fully seat in the opening 22, the connector 24 is stretched, and then due to its elastic nature fully or partially returns to its un-deformed shape as shown in FIG. 9. Each recess 18, 20 may include a curved guide surface 42 adjacent to the associated notch 38, 40 to guide the protrusions 28 into the associated notches 38, 40 (FIG. 6 or 7). In one embodiment, the connector 24 remains under tension when fully seated in the opening 22 to pull the tread 16 and beam 14 tight and secured together. Alternately, the connector 24 fully returns to its un-deformed shape when seated in the opening 22 but still secures the tread 16 and beam 14 and prevents them from being vertically separated.

In one embodiment, the system 10 is configured such that the connector 24 is first placed into the upper notch 38, and then placed into the lower notch 40. Since the upper guide surface 42 presents a higher "hump" than the lower guide surface 42 in the illustrated embodiment, the connector 24 will not need to be stretched as much when it is fit into the lower notch 40, thereby providing ease of insertion. In addition, the lower opening 32 may provide greater ease of access to the lower notch 40 than the upper opening 30 provides to the upper notch 38. However, if desired the connector 24 may be first placed into the lower notch 40 and then the upper notch 38, and system 10 may be configured to aid mounting the connector 24 in this manner. The connector 24 is thus configured to be entered into the opening 22 is one direction (laterally, in the illustrated embodiment) and limit movement of the coupled components in another direction (i.e. vertically, or perpendicular to the entry direction, in the illustrated embodiment).

Figure 10:
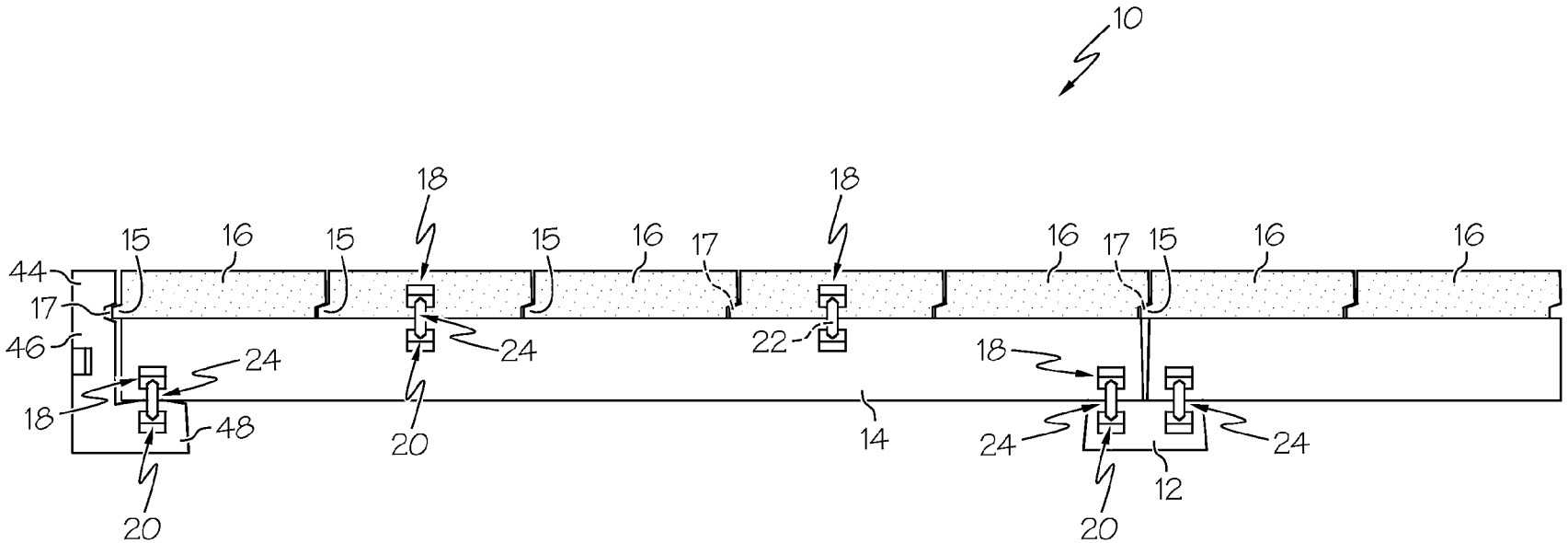
FIG. 10 is a side cross section of another boardwalk system.

The connectors 24 can be used to couple various other components of the system 10, besides treads 16 and beams 14. For example, FIG. 10 illustrates one embodiment in which the beams 14 are coupled to a support 12 by the connectors 24. In this case, each beam 14 may have a recess or opening on its bottom surface generally corresponding to the recesses 18 described above. Similarly, each support 12 may have a recess or opening on its side surface generally corresponding to the recesses 20 described above. The supports 12 and beam 14 can thereby be coupled in the manner described above and shown in FIGS. 3-9 and described in the accompanying text.

FIG. 10 also illustrates a beam cap/abutment 44 positioned at an end of the treads 16. The beam cap/abutment 44 is generally "L" shaped in the illustrated embodiment, and includes an end portion 46 and an underlying portion 48. The end portion 46 of the beam cap 44 has a groove 17 positioned and configured to receive the tongue 15 of the end tread 16 to provide a finished appearance to the system 10 and retain the treads 16 in place. The underlying portion 48 of the end cap 44 is positioned below the associated beam 14, and coupled to the beam 14 by a connector 24 in the same manner or similar as described above for the support 12/beam 14 and beam 14/tread 16.

Figure 11:
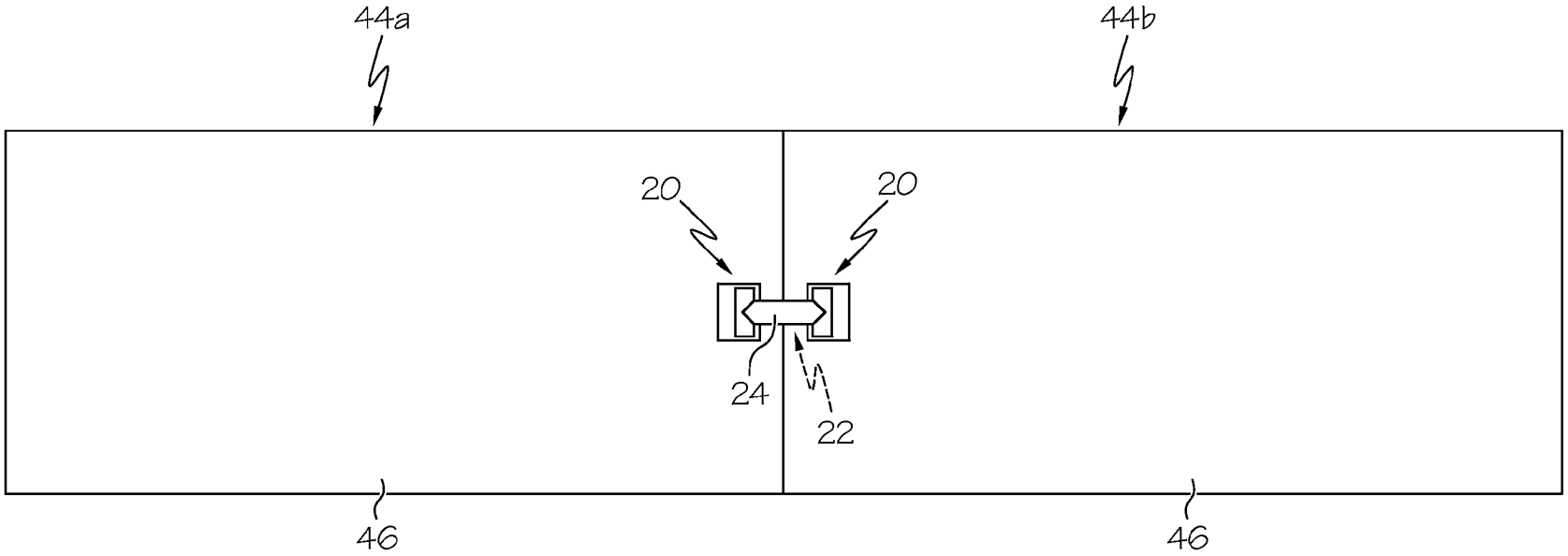
FIG. 11 is an end view of an end cap of the system of FIG. 10.

FIGS. 1-10 illustrate various embodiment in which the connector 24 is received in, and coupled to, generally perpendicular surfaces, and in a vertical configuration. However, the connector 24 can also be utilized to secure components at generally parallel or aligned surface, and/or in a horizontal configuration. For example, FIG. 11 illustrates a connector 24 securing two lateral portions of the beam cap 44 together. In this embodiment, the opening 22 is formed by two generally aligned, cooperating openings 20, both formed in the end outer surface of the beam cap 44*a*, 44*b*. The connector 24 thereby enables modular supports beam caps 44 made of various support portions to be build up as desired. The connector 24 can also be used in various other positions throughout the boardwalk system 10, or other structures.

Thus, the connector 24 and system 10 disclosed herein provides a quick, easy and inexpensive system for securely coupling first or upper components (treads, beams, or other components) to second, underlying or adjacent components (beams, supports, or other components). In addition, in one embodiment the system 10 described herein can be implemented manually or with hand tools, and without the use of any power tools.

Moreover, the system 10 is conveniently reversible when it is desired to disassemble, repair or replace the system, as each connector 24 may be able to be extracted out of the associated opening 22 by drilling through the connector 24 and pulling it out of the opening 22/recesses 18, 20. However, the connectors 24 may generally remain in place during the application of uplift forces, such as wind, water or hydraulic forces or other uplift, lateral or associated forces. In addition, the recesses 18 of each upper component may be positioned only on the underside of the associated component (tread 16, beam 14 or other component) spaced away from the top surface. Thus the recess 18 and connectors 24 are concealed from the top surface of the treads 16, beam 18 or other component to provide a pleasing continuous appearance, reduce accumulation of standing water, and reduce trip hazards to pedestrians and the like. Similarly, if desired, the recesses 20 of each lower component may be positioned on only one side, which can reduce exposure to the elements.

Having described the invention in detail and by reference to certain embodiments, it will be apparent that modifications and variations thereof are possible without departing from the scope of the invention.

What is claimed is:

1. A boardwalk system comprising:

a tread having a tread pre-formed recess;

a beam having a beam pre-formed recess; and a connector configured to be positioned in said pre-formed recesses of said tread and said beam to connect said tread and said beam such that said connector limits the movement of said tread away from said beam, wherein said tread pre-formed recess and said beam pre-formed recess are configured to, when properly aligned such that said tread is generally horizontally aligned and supported by a beam thereunder, together define an entry path through which said connector must be passed to connect said tread and said beam such that said connector limits the movement of said tread away from said beam, and wherein said entry path and said connector are configured such that said connector must be stretched and placed into tension to pass through said entry path to limit the movement of said tread away from said beam.

2. The system of claim 1 wherein said connector includes a central stem and a pair of opposed protrusions, each protrusion being positioned at or adjacent an end of said central stem, and wherein said tread recess receives one protrusion therein and said beam recess receives the other protrusion therein, and wherein said connector is elastically stretchable along said central stem.

3. The system of claim 2 wherein said central stem is generally elongated, and wherein each protrusion is oriented generally perpendicular to said central stem and extends outwardly in both directions from said central stem such that said connector is generally "I" shaped.

4. The system of claim 2 wherein said entry path has an area of maximum height which is greater than a length dimension of the connector central stem.

5. The system of claim 2 wherein each protrusion has a length shorter than a length of said central stem.

6. The system of claim 1 wherein said connector is configured to be positioned in said recesses in a first direction, and wherein said connector limits the movement of said tread away from said beam in a direction generally perpendicular to said first direction.

7. The system of claim 1 wherein said recesses of tread and said beam are generally aligned.

8. The system of claim 7 wherein said aligned recesses are configured to closely receive said connector therein.

9. The system of claim 1 wherein said connector is elastically deformable such that said connector is stretchable at least about 10% of an original length of said connector without breaking.

10. The system of claim 1 wherein said tread and said beam are both primarily made of concrete.

11. The system of claim 1 wherein said connector is positioned in said recesses of said tread and said beam to connect tread and said beam such that said connector limits the movement of tread away from said beam.

12. The system of claim 11 wherein said connector is in a state of tension.

13. The system of claim 11 wherein said tread and includes a supplemental pre-formed recess positioned at an opposite end thereof relative to said tread pre-formed recess, and wherein the system includes a supplemental beam supporting said tread thereon, said supplemental beam including a pre-formed recess therein, and wherein the system further includes a supplemental connector positioned in said supplemental recesses to connect said tread to said supplemental beam, wherein said supplemental connector limits the movement of said tread away from said supplemental beam.

14. The system of claim 11 wherein said tread pre-formed recess is positioned only on a horizontally-oriented underside surface thereof with respect to a gravitational frame of reference.

15. The system of claim 11 wherein said system includes a plurality of treads which together define a generally continuous upper surface which can be walked upon.

16. The system of claim 15 wherein each tread is positioned generally perpendicular to said beam.

17. The system of claim 15 wherein at least some of said plurality of said treads lack any pre-formed recess configured to receive a connector therein.

18. The system of claim 1 wherein said tread is positioned vertically above said beam, and wherein said connector limits the movement of said tread vertically upwardly and away from said beam with respect to a gravitational frame of reference.

19. The system of claim 18 wherein the beam directly supports at least part of the weight of the tread thereon.

20. The system of claim 1 wherein said tread has at least three discrete, spaced apart tread pre-formed recesses, and wherein said beam has at least three discrete, spaced apart beam pre-formed recesses.

21. The system of claim 1 wherein said connector is a unitary one-piece connector.

22. The system of claim 21 wherein said connector is sized and configured to be entirely received in said aligned pre-formed recesses.

23. The system of claim 1 wherein said tread and said beam are in direct contact with each other.

24. The system of claim 1 wherein said tread and said beam are pulled together by said connector.

25. The system of claim 1 wherein said connector is directly coupled to only said tread and said beam.

26. A boardwalk system comprising:

a plurality of generally horizontally arranged treads, at least one tread having a pre-formed tread recess;

a plurality of beams, each tread having a weight being at least partially supported by an underlying beam, at least one beam having a pre-formed beam recess, wherein said pre-formed tread recess of said at least one tread and said pre-formed beam recess of said at least one beam are aligned and in communication with each other defining an entry path; and a connector positioned in said aligned recesses and connecting said associated tread to said associated beam, wherein said connector limits the movement of said associated tread upwardly away from said associated beam with respect to a gravitational frame of reference, and wherein said entry path and said connector are configured such that said connector must be stretched and placed into tension to pass through at least part of said entry path.

27. A method for assembling a boardwalk system comprising:

accessing a plurality of treads, at least one tread having a pre-formed tread recess;

accessing a plurality of beams, at least one beam having a pre-formed beam recess;

positioning said plurality of treads such that each tread is positioned generally horizontally and adjacent to at least one beam supporting said tread thereon; and positioning a connector in said recesses of said at least one tread and said at least one beam while least temporarily placing said connector in tension, to thereby connect said at least one tread to said at least one beam and limit the movement of said at least one tread away from said at least one beam.

28. The method of claim 27 wherein the second positioning step includes elastically stretching the connector as the connector is placed in at least one recess of said at least one tread and said at least one second beam, and allowing the connector to at least partially return to its original, unstretched condition.

29. The method of claim 27 wherein the second positioning step includes elastically deforming the connector in order to position the connector in said recesses.

* * * * *